US005709301A

United States Patent [19]

Couch et al.

[11] Patent Number: 5,709,301

[45] Date of Patent: Jan. 20, 1998

[54] PAINTING IMPLEMENT KEEPER

[76] Inventors: Robert Lincoln Couch; Ronald Norman Couch, both of 1820 Schaeffer Rd., Knoxville, Tenn. 37932

[21] Appl. No.: 742,746

[22] Filed: Nov. 1, 1996

[51] Int. Cl.[6] ..... B65D 41/28; B65D 41/18

[52] U.S. Cl. ..... 206/361; 206/15.3; 220/801; 220/804; 215/321

[58] Field of Search ..... 206/15.2, 15.3, 206/361, 362, 446, 408, 523, 591, 592; 220/735, 789, 796, 801, 804, 378; 215/354, 355, 321

[56] References Cited

U.S. PATENT DOCUMENTS

| | | | |
|---|---|---|---|
| 2,424,553 | 7/1947 | Conti | 206/408 |
| 2,533,355 | 12/1950 | Comfort . | |
| 2,782,909 | 2/1957 | McNamara . | |
| 3,187,886 | 6/1965 | Honey | 206/523 |
| 3,826,358 | 7/1974 | Butler et al. | 206/523 |
| 3,904,362 | 9/1975 | DiPaolo | 206/362 |
| 3,918,582 | 11/1975 | Wallace . | |
| 4,215,786 | 8/1980 | Vertes | 206/591 |
| 4,533,044 | 8/1985 | Ban . | |
| 4,560,069 | 12/1985 | Simon | 206/523 |
| 4,738,358 | 4/1988 | Kehl | 206/361 |
| 4,771,501 | 9/1988 | Leiter . | |
| 4,872,563 | 10/1989 | Warder et al. | 206/523 |
| 4,880,114 | 11/1989 | Korte | 206/591 |
| 4,936,452 | 6/1990 | Pauley | 206/408 |
| 5,178,274 | 1/1993 | Long | 206/15.3 |
| 5,301,799 | 4/1994 | Gurba, Jr. . | |
| 5,515,971 | 5/1996 | Segrest | 206/591 |
| 5,533,617 | 7/1996 | Von Flatern | 206/15.3 |

FOREIGN PATENT DOCUMENTS

| | | |
|---|---|---|
| 585262 | 10/1959 | Canada . |
| 2351248 | 4/1975 | Germany . |
| 92/20596 | 11/1992 | WIPO . |

*Primary Examiner*—Paul T. Sewell
*Assistant Examiner*—Anthony Stashick
*Attorney, Agent, or Firm*—Richard C. Litman

[57] ABSTRACT

Storage devices for paint rollers, paint roller covers, and paint brushes. The storage devices for the paint rollers and paint roller covers are cylindrical containers, having a lid, which are flared outwardly at their upper portions and have a foam insert at the bottom for forming a spongy seal with the painting implement. The container for the cover has a core in it around which the roller cover fits. The lid, which can be either a screw down or a friction fit lid, has a foam insert on its underside to form a spongy seal with the upper part of the roller cover. The container for the roller and the lid, which must be a friction fit lid, each have a semicircular opening lined with a gasket. The mating of the container and the lid result in the formation of a circular opening through which the handle of a roller frame can extend. The paint brush holder is a rectangular-shaped container having a foam insert fitted to its upper portion. The exterior of the insert is sized to fit the container. The insert has an opening for holding a paint brush collar to allow the bristles to be in the container without touching the bottom. The insert keeps the brush wet and from drying out. The insert can be replaced with an insert having the same exterior size, which will fit the container, and a different sized interior surface, to hold another size of paint brush.

2 Claims, 3 Drawing Sheets

PAINTING IMPLEMENT KEEPER

BACKGROUND OF THE INVENTION

1. Field of the Invention

The present invention relates to storage devices for painting implements, specifically paint rollers, covers and paint brushes.

2. Description of the Prior Art

The instant invention relates to storage devices for paint rollers and covers and paint brushes. The storage devices for the paint rollers and paint roller covers are cylindrical containers, having a lid, which are flared outwardly at their upper portions and have a foam insert at the bottom for forming a spongy seal with the painting implement. The paint brush holder is a rectangularly-shaped container having a foam insert with an exterior surface fitted to conform to the upper portion of the container. Various foam inserts having different interior sizes for holding different sizes of paint brushes can be used with the container.

Containers for storing painting implements are well known in the prior art. For example, U.S. Pat. No. 2,782,909, issued on Feb. 26, 1957 to Paul E. McNamara, teaches a retaining sleeve for holding a paint brush in a container. Unlike this prior apparatus, the instant invention can be used to hold different sizes of brushes merely by replacing the insert because it holds the brush at the collar, which varies with the size of the brush. Further, the instant invention maintains a foam insert in contact with the brush to prevent its drying out. Finally, other features of the instant invention, for example the foam inserts in the cylindrical container, are not seen in the prior art.

SUMMARY OF THE INVENTION

The present invention relates to storage devices for paint rollers, paint roller covers, and paint brushes. The storage devices for the paint rollers and paint roller covers are cylindrical containers, having a lid, which are flared outwardly at their upper portions and have a foam insert at the bottom for forming a spongy seal with the painting implement. The container for the cover has a core in it around which the roller cover fits. The lid, which can be either a screw down or a friction fit lid, has a foam insert on its underside to form a spongy seal with the upper part of the roller cover.

The container for the roller and the lid, which must be a friction fit lid, each have a semicircular opening lined with a gasket. The mating of the container and the lid result in the formation of a circular opening through which the handle of a roller frame can extend.

The paint brush holder is a rectangular-shaped container having a foam insert fitted to its upper portion. The exterior of the insert is sized to fit the container. The insert has an opening for holding a paint brush collar to allow the bristles to be in the container without touching the bottom. The insert keeps the brush wet and from drying out. The insert can be replaced with an insert having the same exterior size, which will fit the container, and a different sized interior surface, to hold another size of paint brush.

In use, the containers are filled with paint so as to cover the painting surface of the painting implement. This submerging of the implement in paint keeps the painting implement wet so that it will not dry out. Additionally, storing the painting implement in this manner means that it does not have to be cleaned with paint thinner after each use.

Accordingly, it is a principal object of the invention to provide storage devices for a paint roller, a paint roller cover, and a paint brush.

It is another object of the invention to minimize the quantity of paint thinner used.

Still another object of the invention is to provide the storage devices with foam inserts to prevent the painting implement from drying out.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The presently claimed paint implement keepers can be used to store paint rollers, paint roller covers, or paint brushes while keeping the painting surface wet with paint. Such an invention reduces the frequency which paint implements must be cleaned and the amount of paint thinner which must be used, resulting in a great environmental benefit. The paint implement keepers are filled with paint and foam inserts maintain a spongy contact with the paint implement, keeping the implement wet.

Figure 1:
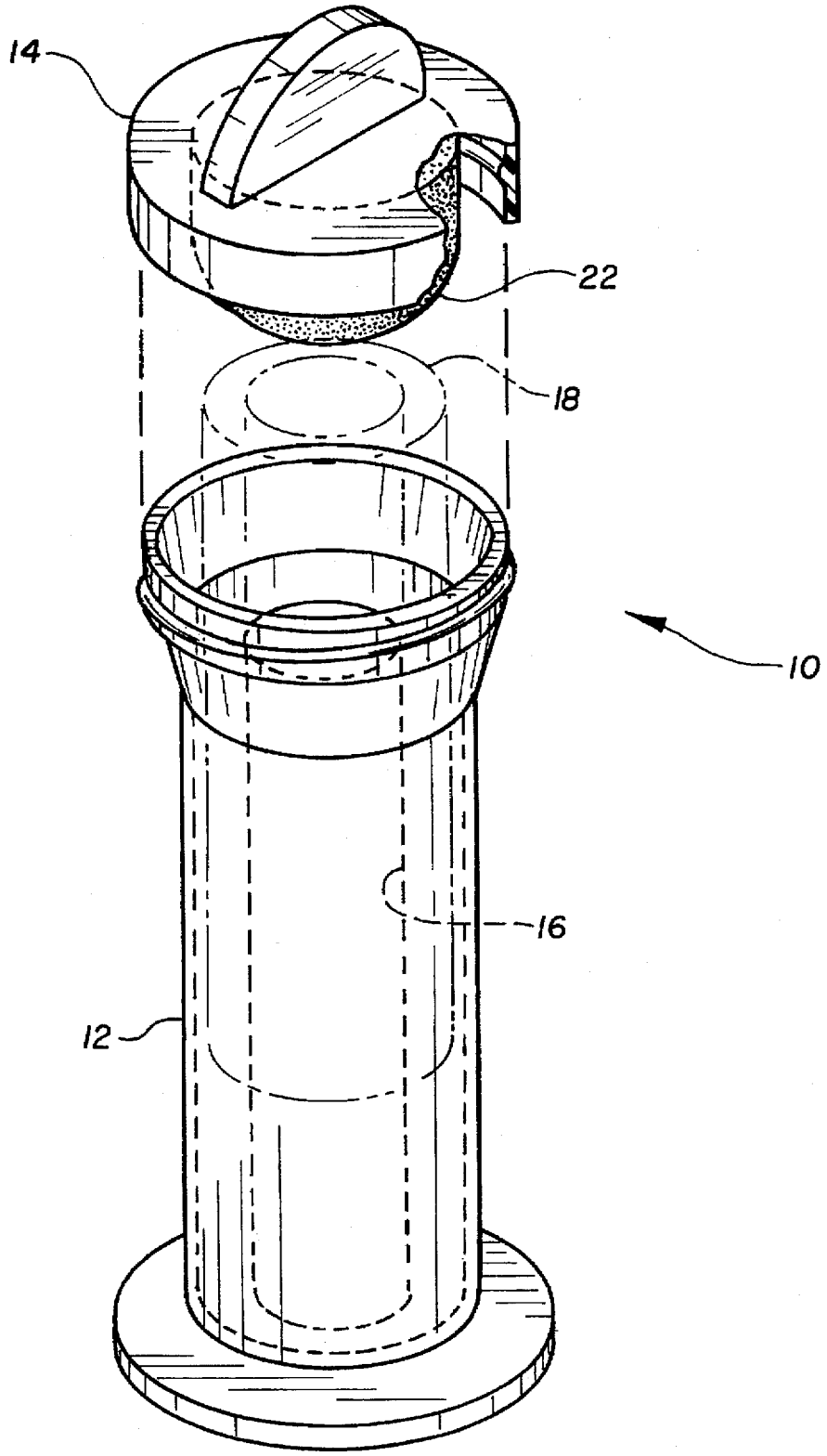
FIG. 1 is a broken-away environmental perspective view of a storage device for a paint roller cover.
Figure 2:
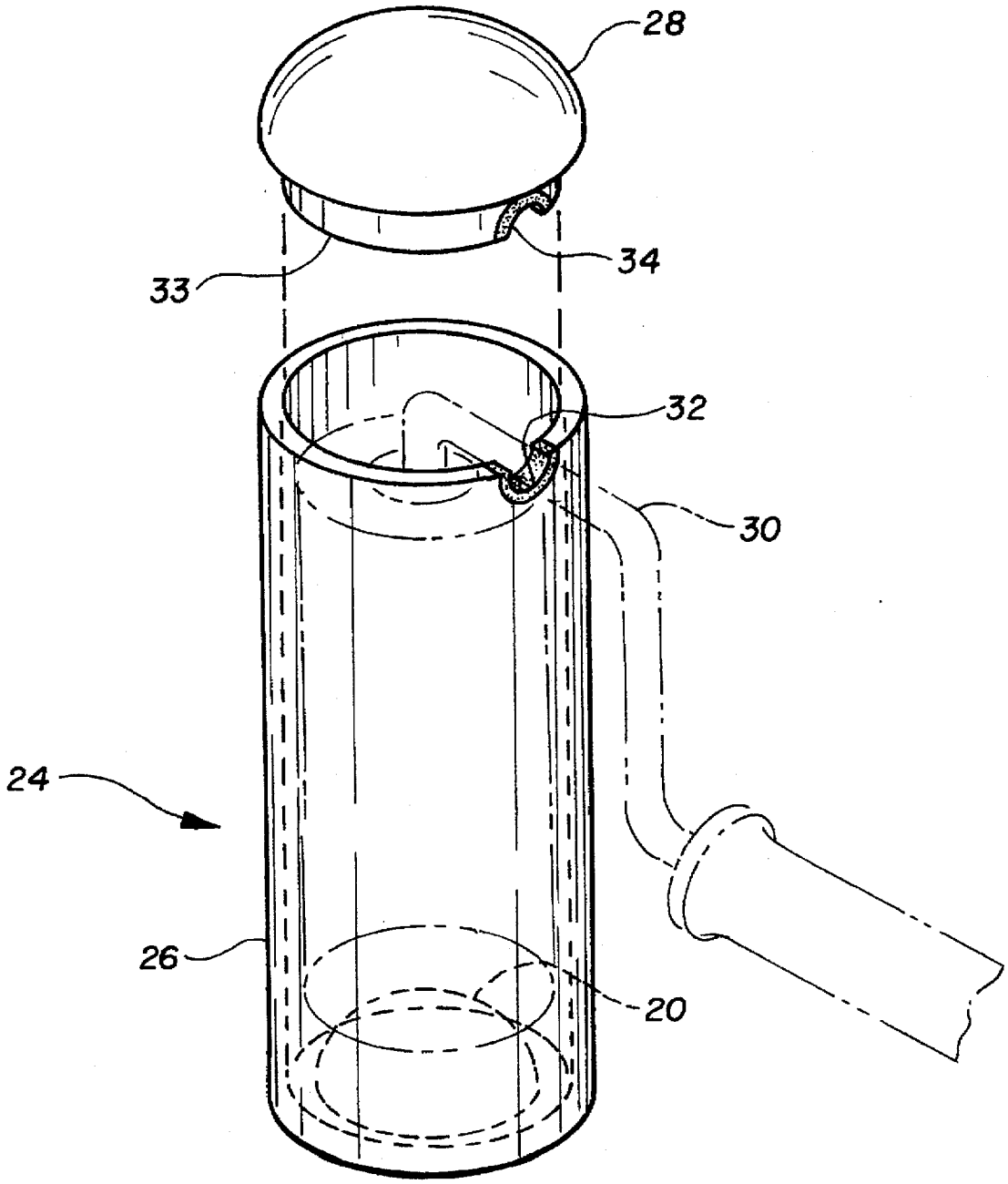
FIG. 2 is an environmental perspective view of a storage device for a paint roller.

FIGS. 1 and 2 show a paint implement keeper which is used for storing a paint roller or a paint roller cover. FIG. 1 shows a paint roller cover keeper 10, which includes a container having a threaded lip and a screw down lid 14. The container includes a core 16 with a closed top over which the paint roller cover 18 is placed. The core 16 serves the purpose of holding the roller cover 18 in place and, more importantly, taking up volume in the container, reducing the amount of paint required to fill up the container 10. The bottom of the container 10 includes a foam rubber insert 20 (shown in FIG. 2) and the underside of the lid 14 includes a foam rubber insert 22 to form a seal with the paint roller cover 18 and keep it moist when submerged in paint. The upper portion of the container 12 is flared outwardly to prevent paint overflow.

The paint roller cover keeper 10 can also utilize a friction fit lid and container. This configuration is seen in FIG. 2 in conjunction with a paint roller keeper 24. The paint roller keeper 24 includes a container 26 and a lid 28 having a cylindrical flange 33. The flange 33 frictionally fits into the container 26. While the paint roller cover keeper 10 can utilize either a screwd own or a friction type configuration, the paint roller keeper 24 can use only the friction type configuration because of the protruding paint roller frame 30. The paint roller frame 30 protrudes out of an opening formed by a semi-circular notch opening 32 at an upper portion of the container 26 and a semi-circular notch opening 34 in the circumferential flange 33 of the lid. When the lid 28 is placed on the container 26, the paint roller frame 30 is surrounded by a gasket-like circular opening.

Figure 3:
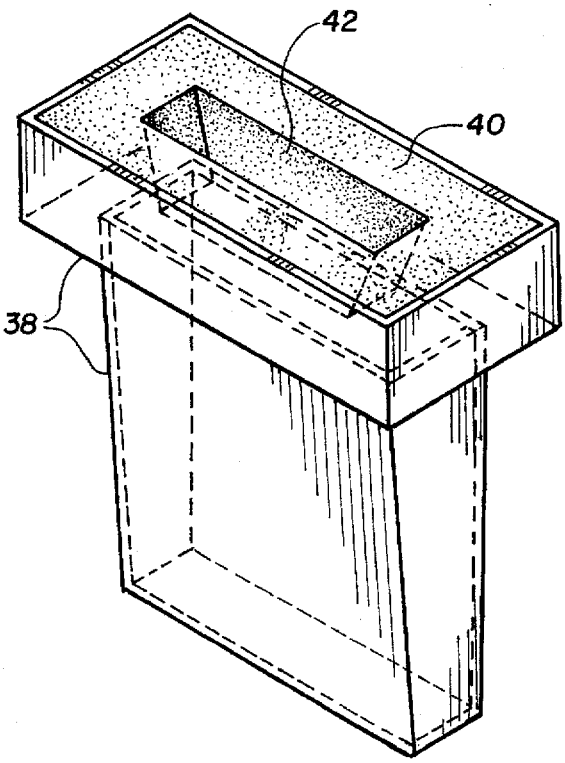
FIG. 3 is a perspective view of a storage device for a paint brush.
Figure 4:
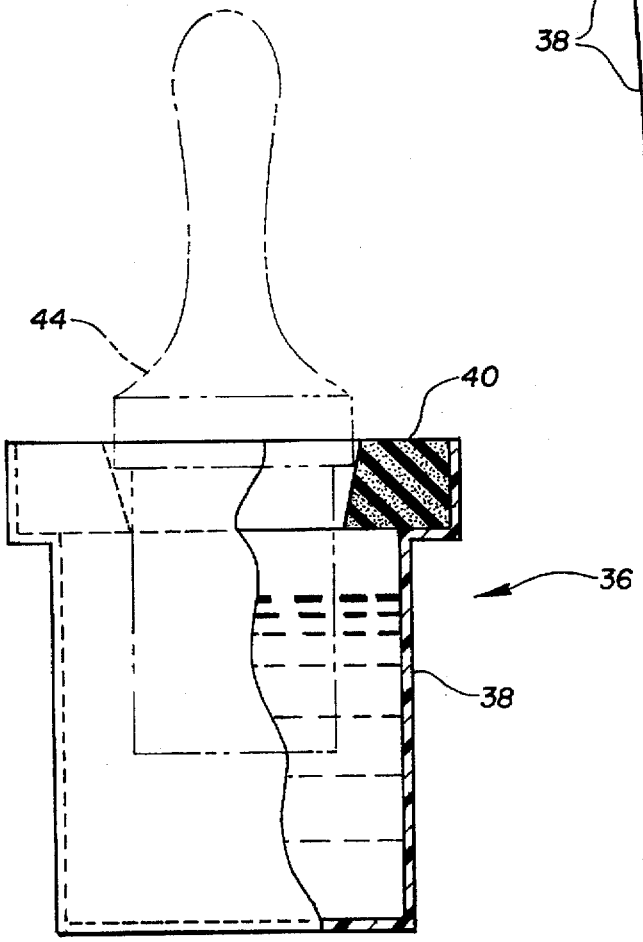
FIG. 4 is an environmental front view of a storage device for a paint brush partially shown in cross section.

The paint brush keeper 36, which is shown in FIGS. 3 and 4, includes a rectangular-shaped container 38 and an insert 40. The container 38 has a lower portion and a larger upper portion. The insert 40 has an opening with an inner surface 42. The size, length, width, and depth, of the insert 40 is such that it will fit into the upper portion of the container 38. The opening in the insert 40 is sized to accommodate a paint brush by frictionally holding the collar 44 of the brush. Different inserts having the same exterior dimensions and different sized openings, can be used with the container 38 for different sized brushes. Inserts 40 having different sized openings have different sized inner surfaces 42 for holding different sized collars 44.

It is to be understood that the present invention is not limited to the embodiments described above, but encompasses any and all embodiments within the scope of the following claims.

We claim:

1. A paint implement keeper comprising:

a cylindrical container having a bottom and an open top with a first semicircular notch, said bottom including a hemispherical foam insert; and a lid having an underside including a hemispherical foam insert, said lid including a circumferential flange for frictionally fitting with said open top of said container, said flange having a second semicircular notch for mating with said first notch to define an opening for inserting a paint roller frame.

2. The paint implement keeper of claim 1 wherein said first notch and said second notch each include a gasket.

* * * * *